US005540720A

United States Patent [19]

Ortega

[11] Patent Number: 5,540,720

[45] Date of Patent: Jul. 30, 1996

[54] TEETHING DEVICE WITH ILLUSTRATIONS THAT SIMULATE A 3-DIMENSOINAL EFFECT

[75] Inventor: Ernesto Ortega, Aberdeen, N.J.

[73] Assignee: Danara International, Ltd., North Bergen, N.J.

[21] Appl. No.: 494,666

[22] Filed: Jun. 26, 1995

[51] Int. Cl.[6] ..... A61J 17/00

[52] U.S. Cl. ..... 606/235; 446/267

[58] Field of Search ..... 446/219, 226, 446/267; 606/234–236

[56] References Cited

U.S. PATENT DOCUMENTS

| | | | |
|---|---|---|---|
| D. 36,283 | 4/1903 | Dunn . | |
| D. 60,947 | 5/1922 | Patrich . | |
| D. 170,357 | 9/1953 | Hayes | D83/8 |
| D. 175,089 | 7/1955 | Newmark | D83/11 |
| D. 242,293 | 11/1976 | Panicci | D83/8 C |
| D. 248,219 | 10/1981 | Schissel | 446/219 |
| D. 341,203 | 11/1993 | Panicci | D24/194 |
| 2,703,087 | 3/1955 | Newmark | 606/235 |
| 3,990,455 | 11/1976 | Panicci | 606/235 |
| 4,116,202 | 9/1978 | Panicci | 606/235 |
| 4,268,030 | 5/1981 | Richards | 446/226 |
| 5,104,699 | 4/1992 | Pantaleo et al. | 446/267 |
| 5,338,243 | 8/1994 | Kieves | 446/226 |

*Primary Examiner*—Gary Jackson
*Assistant Examiner*—Glenn Dawson
*Attorney, Agent, or Firm*—Kenyon & Kenyon

[57] ABSTRACT

A teething aid and toy includes upper and lower sheets of a transparent plastic material sealed together along their edges to form an internal cavity between the upper and lower sheets. The internal cavity is in the form of a number of cells each having its long axis in the same plane as the plane of the teething aid. The cells are connected by narrow necks set inwardly from the edge seals which define a single flow path. The cells are filled with a transparent liquid. Decorative drawings and/or paintings are affixed to both sheets that form the teething aid. The illustration on the lower sheet faces the inner liquid-filled cavity, so as to create the impression of a three-dimensional drawing to a viewer who views the upper sheet of the teething aid.

8 Claims, 1 Drawing Sheet

TEETHING DEVICE WITH ILLUSTRATIONS THAT SIMULATE A 3-DIMENSOINAL EFFECT

FIELD OF THE INVENTION

This invention relates to teething aids and toys, more particularly to fluid-filled teething devices and toys having decorative paintings and drawings.

BACKGROUND OF THE INVENTION

Fluid-filled teething devices made from sheet polyvinyl chloride cut to form enlarged cells connected by narrow necks which permit and define fluid flow between cells, have been known. Typically, such teething aids have consisted of two such transparent sheets sealed together at their edges to form an internal cavity, with decorative objects optionally placed within each cell. Fluid, e.g., water, is then injected into the internal cavity of the sealed sheets, passing through the fluid flow paths defined by the necks and inflating the cells. The fluid flow paths between cells thus facilitate a simple filling procedure and also activate the optional decorative objects when the filled tube is squeezed forcing fluid between the cells. The ends of the tube are then sealed.

When formed in a ring, bending of the teething aid occurs at the narrow necks. The stresses imposed on the material at the necks, which are inflated out of the plane of the sheet material, may result in rupture of the tube at the necks with consequent leakage of fluid from, and collapse of, the tube. Rupture of the tubes may further result in the release of the optional decorative objects contained in each cell, causing danger of choking in infants.

SUMMARY OF THE INVENTION

It is an object of the invention to provide a new and improved teething aid and infant's toy, which provides a 3-dimensional effect for decorative drawings.

It is also an object to provide a new and improved toy and teething aid which provides a 3-dimensional effect for decorative drawings, further having a minimal possibility of rupture at the necks that communicate the cells.

It is also an object to provide a new and improved toy and teething aid which provides a 3-dimensional effect for decorative drawings, in which the danger of choking on any objects that may be released upon rupture of the teething aid is not present.

The invention comprises a teething aid and toy, comprising upper and lower sheets of a transparent plastic material sealed together along their edges such that said sheets define an internal cavity therebetween. Decorative drawings and/or paintings are imprinted at least on the inner surfaces of transparent sheets forming the ring so that they face the user through the liquid-filled cell, thereby creating the impression of a three-dimensional scene. In this way the user sees the decorative drawing through the liquid to provide a 3D effect.

DETAILED DESCRIPTION OF THE INVENTION

Figure 1:
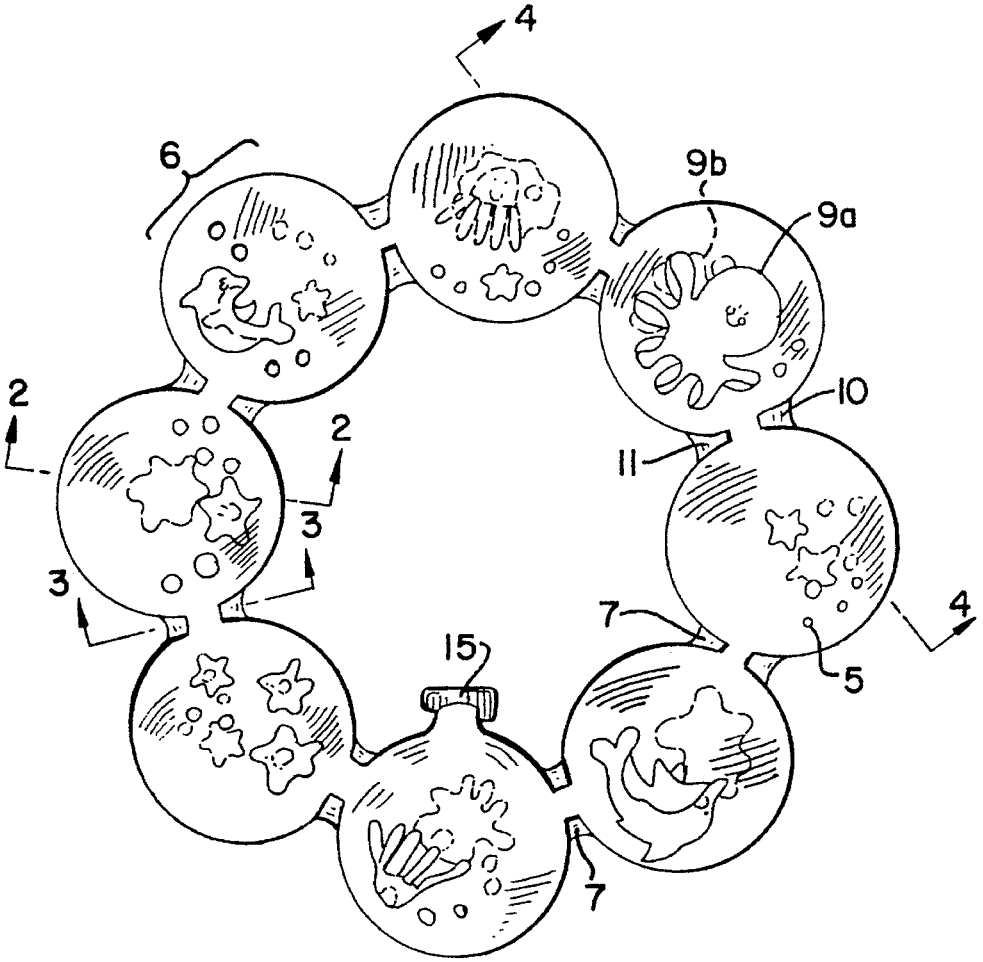
FIG. 1 is a top elevational view of a teething aid and toy embodying the invention. The solid lines of drawing 9*a* indicate that this drawing is on the inner surface of the upper transparent sheet; the broken lines of drawing 9*b* indicate that this drawing is on the inner surface of the bottom transparent sheet.
Figure 2:
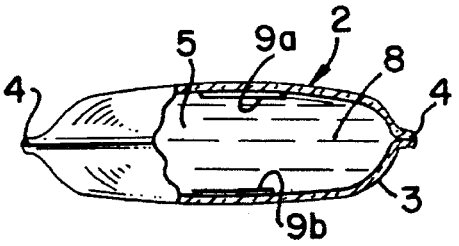
FIG. 2 is a fragmentary sectional view, partially broken away, of a single cell of the invention viewed from the side, taken along the line 2—2 of FIG. 1.
Figure 3:
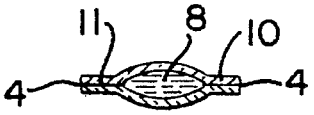
FIG. 3 is an fragmentary sectional view, partially broken away, of the neck connecting two cells of the invention, taken along the line 3—3 of FIG. 1.
Figure 4:
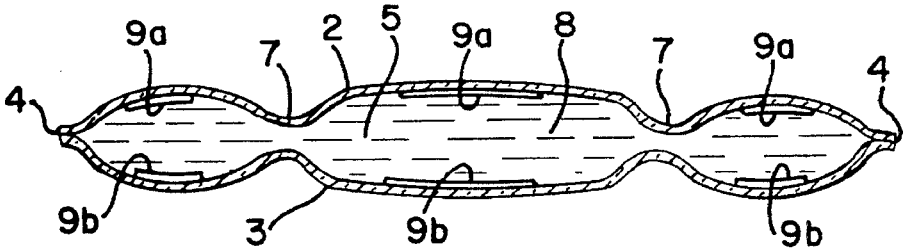
FIG. 4 is a cross-sectional view of a cell, the necks that connect that cell to two adjacent cells, and the two adjacent cells, taken along the line 4—4 of FIG. 1.

The toy and teething aid 1 as illustrated in FIG. 1 Is formed of two separate sheets 2, 3 of a flexible transparent nontoxic thermoplastic material such as polyvinyl chloride which are sealed together along their edges 4 so as form a tubular ring. The ends 4 are sealed together to enclose an internal tubular cavity 5. The teething aid sealing may be accomplished by a conventional dielectric sealing process. As shown in FIGS. 1 and 4, the sheets 2, 3 are cut to form enlarged cells 6 interconnected by narrow necks 7. The internal cavity of the teething aid is filled with liquid 8 through spout 15, which is then sealed, preferably under pressure. The necks define fluid flow paths between adjacent cells 6.

Illustrations, such as decorative drawings and/or paintings 9*b* are placed on the surface of the sheet 3 that faces the inner cavity of the cells 6 at the positions of the cells 6 before the edges are sealed. The painting and/or drawing 9*b* is applied in a conventional manner. By applying the illustration 9*b* to the inner surface of the lower sheet 3, it can be seen that the drawing is visible to the user only through the liquid-filled cell (assuming the user looks at the teething aid from an elevational view with the upper sheet 2 facing upwards as is FIG. 1). Another set of paintings and/or drawings 9*a* is applied to the inner surface of the opposite sheet 2 (i.e., the upper sheet). The drawings applied to upper sheet 2 are exposed to the user generally in front of the drawings applied to sheet 3 again assuming an elevational view as in FIG. 1.

At each neck 7, spaced inwardly from the sealed edges of sheets 2, 3, a pair of seals 10, 11 are provided to reduce the maximum height of the passages or flow paths 12, 13, 14 from the plane of sheets 2, 3. The reduced height of the passages 12, 13 relative to the plane of the sheet material minimizes the stresses imposed on the material when the necks are bent, reducing the likelihood of rupture and fluid leakage.

The juxtaposition of the decorative drawing and/or painting 9*a* on upper sheet 2 with the decorative drawing and/or painting 9*b* on lower sheet 3 creates the illusion of a three dimensional scene, because the user sees drawing 9*b* only through the liquid in the liquid-filled cell 6 (again assuming the elevational view of FIG. 1). Thus, it is a critical aspect of this invention that the lower sheet 3 include as illustration 9*b* which faces upward toward the upper sheet 2 so that a viewer from a top elevational view of the teething aid sees illustration 9*b* only through the liquid contained in the cavity 5.

Other embodiments of this invention will occur to those skilled in the art from the preceding detailed description of a preferred embodiment and the accompanying drawings which are within the scope of the following claims.

What is claimed is:

1. A liquid-filled teething aid comprising: an upper sheet of flexible transparent material; a lower sheet of flexible material joined to the upper sheet to define a cavity therebetween; liquid contained in the cavity; an illustration affixed on the lower sheet, said illustration facing the liquid in the cavity; and a second illustration affixed on the upper sheet juxtaposed generally above the illustration on the lower sheet and facing away from the liquid in the cavity, whereby a 3-dimensional impression of said illustrations results when viewing them from an elevational view with the upper sheet facing the viewer.

2. The teething aid according to claim 1 wherein the illustrations are affixed on an inner cavity surface of the upper sheet and an inner cavity surface of the lower sheet.

3. The teething aid according to claim 1 wherein the lower sheet is transparent.

4. The teething aid according to claim 1 wherein the upper and lower sheets define a plurality of cells and neck regions between adjacent cells.

5. The teething aid according to claim 4 wherein said necks permit liquid communication between adjacent cells.

6. The teething aid according to claim 1 wherein the liquid is water.

7. The teething aid according to claim 1 in the form of a ring.

8. The teething aid according to claim 1 wherein the upper and lower sheets consist of a transparent thermoplastic material.

* * * * *

UNITED STATES PATENT AND TRADEMARK OFFICE
Certificate

Patent No. 5,540,720 Patented: July 30, 1996

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Georgene Griffin, Maywood, NJ.

Signed and Sealed this Twenty-Ninth Day of June, 1999.

MICHAEL BUIZ
*SPE*, Art Unit 3731